US007628395B2

(12) United States Patent
Shiga et al.

(10) Patent No.: US 7,628,395 B2
(45) Date of Patent: Dec. 8, 2009

(54) SHEET FEEDING DEVICE AND IMAGE FORMING APPARATUS

(75) Inventors: Yuki Shiga, Osaka (JP); Koji Murata, Osaka (JP)

(73) Assignee: Kyocera Mita Corporation (JP)

( * ) Notice: Subject to any disclaimer, the term of this patent is extended or adjusted under 35 U.S.C. 154(b) by 125 days.

(21) Appl. No.: 11/901,859

(22) Filed: Sep. 19, 2007

(65) Prior Publication Data

US 2008/0067738 A1 Mar. 20, 2008

(30) Foreign Application Priority Data

Sep. 20, 2006 (JP) ..... 2006-254582

(51) Int. Cl.
*B65H 1/00* (2006.01)

(52) U.S. Cl. ..... 271/145; 271/171; 271/220

(58) Field of Classification Search ..... 271/171, 271/145, 10.01, 220
See application file for complete search history.

(56) References Cited

U.S. PATENT DOCUMENTS

| | | | | |
|---|---|---|---|---|
| 6,254,086 | B1 * | 7/2001 | Sunou et al. | 271/171 |
| 7,484,728 | B2 * | 2/2009 | Yonemoto | 271/171 |
| 2003/0075858 | A1 * | 4/2003 | Vedoy | 271/171 |

FOREIGN PATENT DOCUMENTS

JP 2002-46869 2/2002

* cited by examiner

*Primary Examiner*—David H Bollinger
(74) *Attorney, Agent, or Firm*—Gerald E. Hespos; Anthony J. Casella

(57) ABSTRACT

A sheet feeding device includes a sheet accommodation portion that accommodates piled sheets, and a guide formed by bending a plate-shaped member and having an abutting surface that abuts on the piled sheets so as to restrict a position of the piled sheets. An inclined surface is formed in a top end portion of the abutting surface. Preferably, one or more than one protruding strip is provided to the guide on a surface on a side where the abutting surface is formed along a direction in which the sheets are inserted into the sheet accommodation portion.

15 Claims, 5 Drawing Sheets

SHEET FEEDING DEVICE AND IMAGE FORMING APPARATUS

BACKGROUND OF THE INVENTION

1. Field of the Invention

The present invention relates to a sheet feeding device that feeds sheets and to an image forming apparatus, such as a copying machine, a facsimile machine, and a printer, to which the sheet feeding device is applied.

2. Description of the Related Art

A sheet feeding device has been used to feed sheets to an image forming apparatus. Generally, the sheet feeding device is provided to the image forming apparatus, and feeds sheets piled inside the sheet feeding device to the image forming apparatus by separating the sheets one by one from the uppermost sheet in the pile using the pick-up roller or the like. Examples of the sheet feeding device include but not limited to a large capacity sheet feeding device external to the image forming apparatus and a sheet feeding cassette provided inside the image forming apparatus main body.

For the sheet feeding device, it is general to provide a guide inside the sheet feeding device. The guide restricts sheets piled inside the sheet feeding device to a specific position or prevents piled sheets from fluctuating or collapsing inside the device for a sheet to be picked up without fail. There is a sheet feeding device configured so as to accommodate therein sheets of a fixed size and there is another sheet feeding device configured so as to accommodate therein sheets of various sizes, such as A4-, A3-, B4-, and B5-size sheets, by making the position of the guide changeable.

To be more concrete, the sheet feeding device opens at the top surface and sheets to be piled are inserted and loaded in the sheet feeding device from the top surface direction. Sheets are normally piled in a horizontal posture inside the sheet feeding device. The guide is therefore provided in a direction perpendicular to the bottom surface of the sheet feeding device and one surface of the guide abuts on the piled sheets at one end. The position of sheets is thus restricted as one surface of the guide abuts on the sheets.

As an example of the sheet feeding device as above, there is a sheet feeding device disclosed in JP-A-2002-046869 (Reference D1). Reference D1 describes an external sheet feeding device that is formed of a guide plate main body abutting on recording materials, an arm portion joined to the guide plate main body, and a fixing portion to which the rear end of the arm portion is joined in a rotatable manner, and it is provided with an arm-coupled guide member that aligns the recording materials at the end position. This configuration allows the arm-coupled guide member to abut on the rear ends of sheets when viewed in a transportation direction of transfer sheets and thereby to align the transfer sheets at the rear end position (see claim 1, FIG. 3, and paragraph [0049] in Reference D1).

In Reference D1, a transfer sheet side guide plate is provided perpendicularly to the bottom surface of the sheet feeding device so as to restrict the position of transfer sheets in the width direction. The transfer sheet side guide plate is formed by joining a fixing plate provided with a long hole to a guide plate main body that abuts on transfer sheets in such a manner that the fixing plate becomes perpendicular to the guide plate, and the transfer sheet side guide plate is fixed (supported) by screwing the fixing plate to the side edge of the sheet feeding device (see FIG. 4, paragraphs [0004] and [0043] in Reference D1).

As has been described, the guide to restrict the sheet position is generally provided perpendicularly to the bottom surface inside the sheet feeding device. In Reference D1, too, the guide plate main body in the arm-coupled guide member and the transfer sheet side guide plate in the width direction of sheets are provided so that the both guides become perpendicular to the bottom surface.

When the guides are provided perpendicularly to the bottom surface of the sheet feeding device, however, there arises a problem that the guides lie in the way when the user replenishes sheets to the sheet feeding device. More specifically, the user hits his or her hands (fingers) holding sheets to be replenished against the top ends of the guides, which interferes with a sheet replenishment work. In particular, when the user replenishes sheets of a small size, he or she is more likely to hit his or her hands against the guides and the guides readily cause a nuisance.

Reference D1 has an object to perform the positioning efficiently with ease of operation when sheets are piled, and no consideration is given to an inconvenience that the user hits his or her hands against the guides. Combined with the configuration that the top ends of the guides are square, the user easily hits his or her hands against the respective guide plates when he or she replenishes sheets, which actually makes sheet replenishment difficult.

SUMMARY OF THE INVENTION

An object of the invention is to provide a sheet feeding device that enables the user to replenish sheets with ease and thereby offers an enhanced convenience to the user.

A sheet feeding device in an aspect of the invention that achieves the above and other objects includes a sheet accommodation portion that accommodates piled sheets, and a guide formed by bending a plate-shaped member and having an abutting surface that abuts on the piled sheets so as to restrict a position of the piled sheets, wherein an inclined surface is formed in a top end portion of the abutting surface.

An image forming apparatus in another aspect of the invention includes an apparatus main body that performs an image forming operation for sheets, and a sheet feeding device that feeds the sheets to the apparatus main body and has the configuration described above.

DETAILED DESCRIPTION OF THE PREFERRED EMBODIMENTS

Hereinafter, one embodiment of the invention will be described with reference to FIG. 1 through FIG. 5. A sheet feeding device 1 described in this embodiment is external to an image forming apparatus 2 (apparatus main body) and has a capacity large enough to accommodate sheets P in units of thousands. It should be appreciated, however, that the configuration, the layout of the respective components, and so forth described in this embodiment are for the purpose of description and not of limitation.

Figure 1:
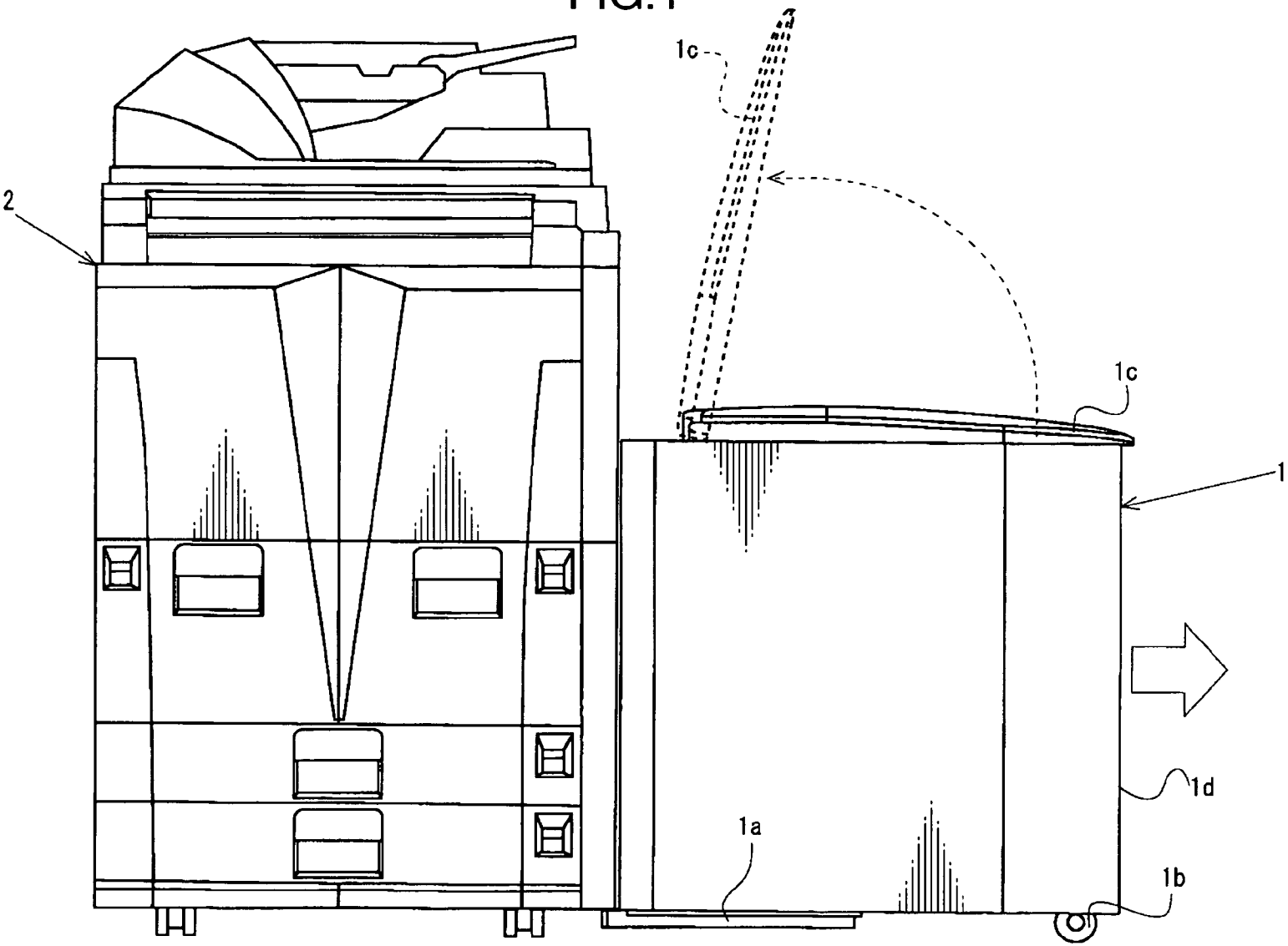
FIG. 1 is a front view of an image forming apparatus provided with a sheet feeding device according to one embodiment of the invention.
Figure 2:
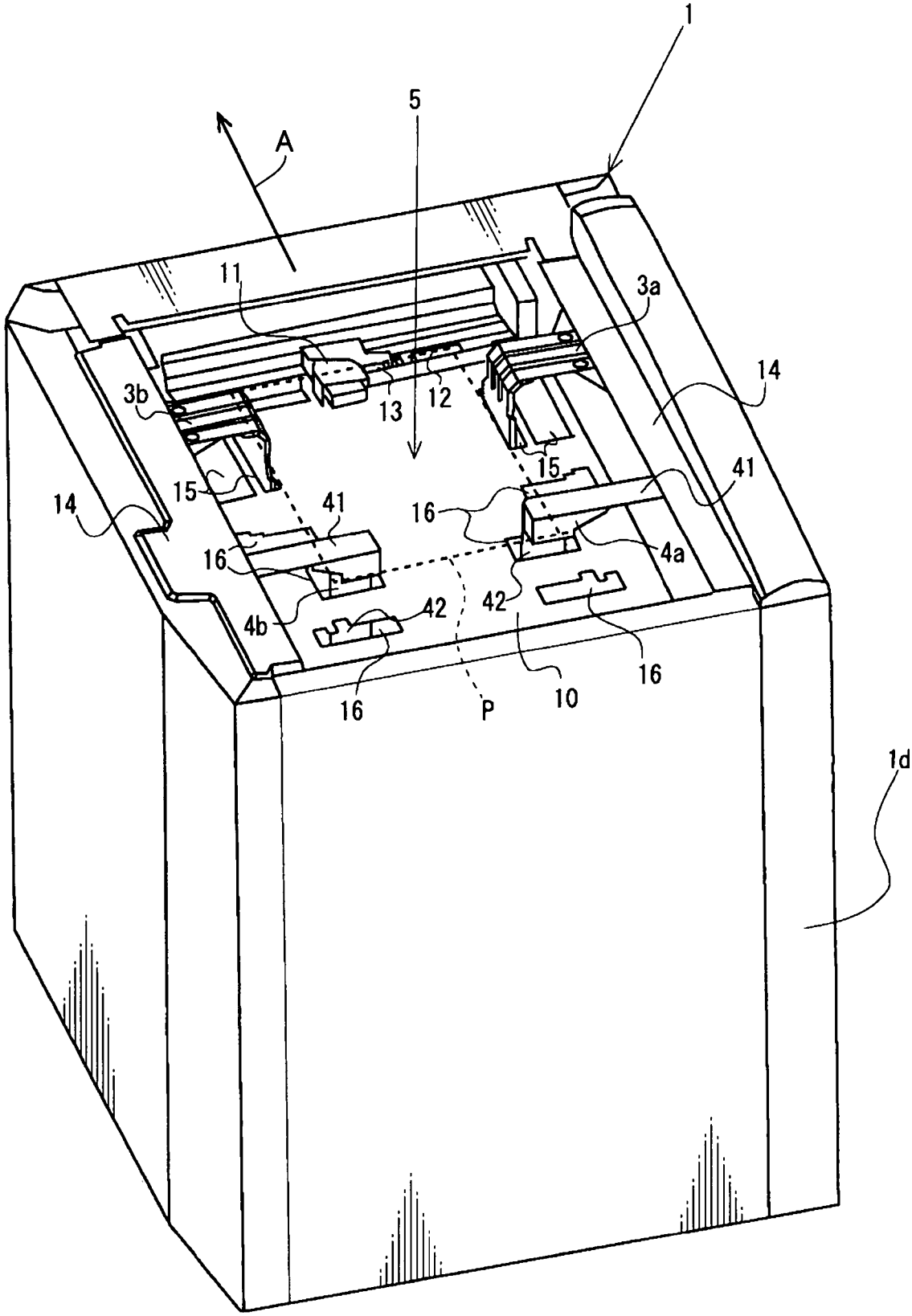
FIG. 2 is a perspective view of the sheet feeding device when viewed from top left.
Figure 3:
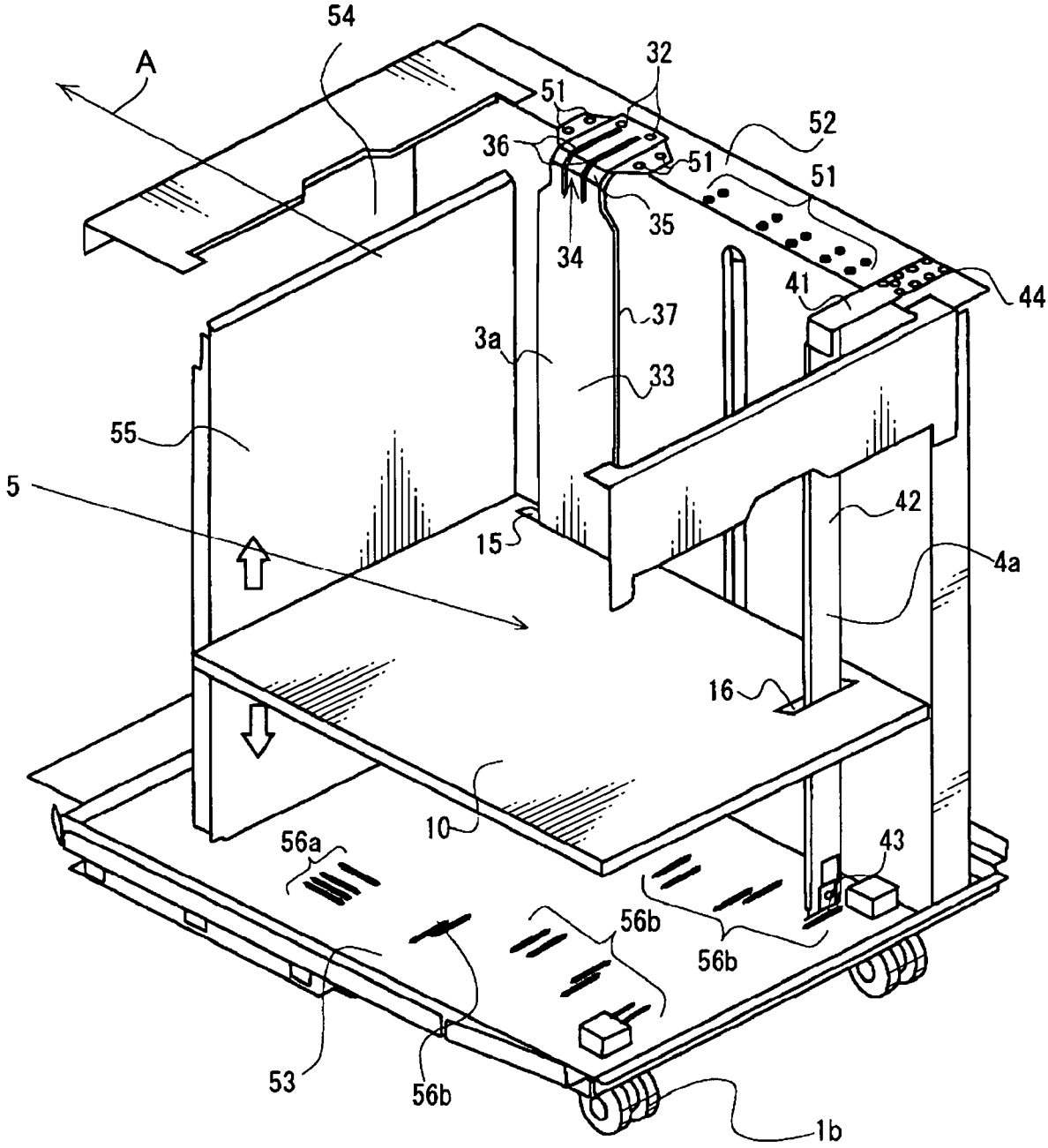
FIG. 3 is a perspective view of the sheet feeding device when viewed from left front used to describe the internal structure thereof.

Firstly, the sheet feeding device 1 according to one embodiment of the invention will be described briefly using FIG. 1 through FIG. 3. FIG. 1 is a front view when the sheet feeding device 1 according to one embodiment of the invention is provided to the image forming apparatus 2. FIG. 2 is a perspective view of the sheet feeding device 1 when viewed from top left. FIG. 3 is a perspective view of the sheet feeding device 1 when viewed from left front used to describe the internal structure thereof.

As is shown in FIG. 1, the sheet feeding device 1 of this embodiment is provided to the side surface of the image forming apparatus 2 (copying machine). Although the structure thereof will be described in detail below, the sheet feeding device 1 of this embodiment is capable of accommodating about four thousand sheets P. Sheets P piled inside the sheet feeding device 1 are sent one by one toward the image forming apparatus 2, and the image forming apparatus 2 forms an image using a sheet P sent therein.

The image forming apparatus 2 can adopt an arbitrary image forming method from the electrophotographic method, the electrostatic recording method, the ink jet method, and so forth. For example, in a case where the electrophotographic method is adopted, the image forming apparatus 2 is formed by including a photoconductive drum, a charging device, an exposing device, a developing device, a cleaning device, and a fixing device, and so forth.

The photoconductive drum is provided so as to be rotatable about the shaft center, and an electrostatic latent image and a toner image are formed on the peripheral surface thereof while it rotates. An image is formed on a sheet P as the toner image on the peripheral surface is transferred onto the sheet P.

The charging device provides charges uniformly to the peripheral surface of the photoconductive drum. The exposing device forms an electrostatic latent image by irradiating a beam according to image information of a document image read by an image reading device to the peripheral surface of the photoconductive drum on which charges are provided uniformly. The developing device forms a toner image by supplying toner particles to the electrostatic latent image formed on the peripheral surface of the photoconductive drum. The cleaning device cleans the photoconductive drum by removing residual toner particles on the peripheral surface thereof after the processing to transfer the toner image onto a sheet P. The fixing device applies fixing processing to the toner image transferred onto the sheet P from the peripheral surface of the photoconductive drum, and includes, for example, a fixing roller having a heating element inside and a pressure roller whose peripheral surface is pressed against the peripheral surface of the fixing roller.

The sheet feeding device 1 is provided with slide rails 1*a* and casters 1*b* at the bottom thereof and is therefore allowed to move in a direction indicated by an outline arrow in FIG. 1, which makes the sheet feeding device 1 attachable to and detachable from the image forming apparatus 2. In the event of an occurrence of jamming (sheet jamming) while a sheet P is being transported from the sheet feeding device 1 to the image forming apparatus 2, it is possible to perform processing to eliminate jamming by detaching the sheet feeding device 1 from the image forming apparatus 2.

A lid portion 1*c* is provided on top of the sheet feeding device 1. A supporting point is provided near the left end of the lid portion 1*c* in FIG. 1 in a direction perpendicular to the sheet surface of FIG. 1, which makes the lid portion 1*c* openable and closable. The lid portion 1*c* in an open state is indicated by a broken line in FIG. 1. While the lid portion 1*c* of the sheet feeding device 1 is open, the sheet feeding device 1 is in a state where it opens at the top surface. The user is thus able to replenish sheets P to the sheet feeding device 1 from the top surface direction.

The structure of the sheet feeding device 1 will now be described with reference to FIG. 2 and FIG. 3. The lid portion 1*c* is omitted in FIG. 2 for ease of illustration.

As is shown in FIG. 2, the sheet feeding device 1 of this embodiment includes two guides 3*a* and 3*b* to restrict the position of sheets P in a direction parallel to a sheet transportation direction (the direction indicated by an arrow A), rear ends 4*a* and 4*b* to restrict the position of the rear ends of sheets P in a direction perpendicular to the sheet transportation direction, a sheet accommodation portion 5 contained inside a housing 1*d* of the sheet feeding device 1 (see FIG. 3), a lifting plate 10 on which sheets P are loaded, a pick-up portion 11 to send piled sheets P one by one toward the image forming apparatus 2, sensors 12 and 13 to confirm a piled state of sheets P, panels 14, and so forth.

Each of the guides 3*a* and 3*b* is formed by bending a plate-shaped member to have a cross section in the vertical direction almost in the shape of a capital L, and restricts the position of sheets P in the direction parallel to the sheet transportation direction. The guides 3*a* and 3*b* will be described in detail below.

Each of the rear end guides 4*a* and 4*b* is formed by joining two members: a fixing member 41 used for fixation to the sheet feeding device 1 and a rear end guide member 42 to restrict the position of sheets P by coming into contact with the rear ends thereof. The rear end guides 4*a* and 4*b* will be described in detail below, too.

The lifting plate 10 is configured so as to be allowed to move up and down in a top-bottom direction. The lifting plate 10 is driven by components, such as a motor, a wire, and a take-up pulley (none of which is shown) capable of rotating forward and backward. The wire is fixed to the take-up pulley at one end and to the lifting plate 10 at the other end so that the lifting plate 10 moves up as the wire is reeled up by the take-up pulley driven by the motor (the inverse mechanism applies when the lifting plate 10 moves down). In addition, sheets P are piled on the lifting plate 10 (the piled position of sheets P is indicated by a broken line in FIG. 2), and the lifting plate 10 moves up gradually as sheets P are reduced. Hence, of the piled sheets P, the uppermost sheet P always abuts on the pick-up portion 11. FIG. 2 shows a state where the lifting plate 10 is fully moved up.

In this embodiment, the lifting plate 10 is provided with four through-holes 15 to let the guides 3*a* and 3*b* insert therein and six through-holes 16 to let the rear end guides 4*a* and 4*b* insert therein. When configured in this manner, the guides 3*a* and 3*b* and the rear end guides 4*a* and 4*b* are able to restrict the position of sheets P piled from bottom to top in the sheet feeding device 1. In addition, because the through-holes 15 and 16 are provided in a plural form, it is possible to change the fixing positions of the guides 3*a* and 3*b* and the rear end guides 4*a* and 4*b*. Accordingly, sheets P of various sizes, such as A4-, A3-, B5-, and B4-size sheets P, can be piled up inside the sheet feeding device 1.

The pick-up portion 11 includes a pick-up roller inside, and picks up sheets P piled on the lifting plate 10 one by one from the uppermost sheet P and sends them toward the image forming apparatus 2. The sheet feeding timing is controlled by a control signal transmitted from the image forming apparatus 2 to the sheet feeding device 1.

This embodiment shows a case where two sensors are provided to confirm the piled state of sheets P. Of the two sensors 12 and 13 provided on the right of the pick up portion 11 in the right-left direction in FIG. 2, the sensor 12 on the right is to detect a sheet running-out state. The sensor 12 that detects a sheet running-out state is a light sensor and is configured to emit light toward the bottom surface of the sheet feeding device 1. A hole is pierced through the lifting plate 10 at the position below the sensor 12, so that when sheets P run out, light emitted from the sensor 12 reaches the bottom surface of the sheet feeding device 1 and a light reception state changes from the state when light is blocked by sheets P in a sheet piled state. The sensor 12 detects that sheets P have run out from this change in state.

Meanwhile, the sensor 13 on the left is to perform an upper limit detection to detect the uppermost level of piled sheets P in preventing the lifting plate 10 from moving up exceedingly. Owing to the presence of the sensor 13, it is possible to control the lifting plate 10 to move up in such a manner that the uppermost sheet P in the pile constantly comes into contact with the pick-up portion 11. In other words, rotations of the motor are controlled by a signal from the sensor 13.

Operations of the sheet feeding device 1 during sheet replenishment will now be described. As has been described, although it depends on a thickness of sheets P, the sheet feeding device 1 of this embodiment is capable of accommodating about four thousand sheets P. Generally, copy sheets are packed on a base of 500. The sheet feeding device 1 of this embodiment is therefore capable of accommodating eight packages.

Because the user cannot replenish as many as four thousand sheets P at a time, he or she repetitively replenishes sheets P, for example, in units of 500. Hence, in the sheet feeding device 1 of this embodiment, the lifting plate 10 moves down by a specific amount as sheets P are replenished. Although it is not shown in the drawing, a sensor to determine an appropriate moving down amount of the lifting portion 10 is separately provided. Rotations of the motor is controlled by a detection of this sensor, so that the lifting plate 10 and the uppermost surface of piled sheets P are at the levels at which the user can replenish sheets P with ease. This enables the user to repetitively replenish sheets P until the lifting plate 10 reaches the allowable lowest level.

The lifting plate 10 moves up by a required amount when the user closes the lid portion 1*c* of the sheet feeding device 1. To be more concrete, the lifting plate 10 moves up until the uppermost sheet P in the pile comes into contact with the pick-up portion 11. In this instance, the sensor 13 for the upper limit detection as described above is used to determine an appropriate moving up amount. In other words, rotations of the motor are controlled by a signal from the sensor 13.

The panels 14 are provided to cover an engagement portion 51 of the sheet accommodation portion 5 described below (see FIG. 3) in a removable manner so as to allow for the change in position of the guides 3*a* and 3*b* and the rear end guides 4*a* and 4*b* when the size of sheets to be accommodate is changed.

The interior of the sheet feeding device 1 and the structure of the sheet accommodation portion 5 will now be described using FIG. 3. For ease of illustration, of a total of four members provided to restrict the positions of sheets P (see FIG. 2), the guide 3*b* and the rear end guide 4*b* as well as a side plate 52 on one side (described below) are omitted in FIG. 3 to show the internal structure on the inner side alone when viewed from front. However, the configuration on the forward side when viewed from front will be described as well.

As is shown in FIG. 3, the sheet feeding device 1 of this embodiment has the sheet accommodation portion 5 inside the housing 1*d*.

The sheet accommodation portion 5 is formed of a bottom plate 53, side plates 52 provided in parallel with the sheet transportation direction indicated by an arrow in FIG. 3, a front wall plate 55 provided below a sheet discharge port 54 in a direction perpendicular to the sheet transportation direction, and so forth. The side plates 52 and the front wall plate 55 are provided to stand upright on the bottom plate 53. The sheet transportation direction is indicated by an arrow A in FIG. 3.

The bottom plate 53 is provided with plural slits 56*a* and 56*b* (first engagement portion) into which are inserted inserting portions 31 and 43 (third engagement portion, see FIG. 4 and FIG. 5) provided at the bottom ends of the guides 3*a* and 3*b* and the rear end guides 4*a* and 4*b*, respectively. The slits 56*a* and 56*b* are provided to match the respective sizes of sheets P. To be more concrete, two kinds of slits 56*a* and 56*b* are provided in a plural form: in the slits 56*a*, the guides 3*a* and 3*b* are inserted in a direction parallel to the sheet transportation direction, and in the slits 56*b*, the rear end guides 4*a* and 4*b* are inserted in a direction perpendicular to the sheet transportation direction. By inserting the inserting portions 31 of the guides 3*a* and 3*b* into the slits 56*a* and the inserting portions 43 of the rear end guides 4*a* and 4*b* into the slits 56*b*, the guides 3*a* and 3*b* and the rear end guides 4*a* and 4*b* are supported at the bottom ends.

Meanwhile, as is shown in FIG. 3, engagement portions 51 (second engagement portion) to be engaged with holes 32 (fourth engagement portion) provided in the top ends of the guides 3*a* and 3*b* and fixing members 41 of the rear end guides 4*a* and 4*b* are provided along the top edges of the side plates 52. The engagement portions 51 are fit to the holes 32 in the guides 3*a* and 3*b* and holes 44 in the fixing members 41 of the rear end guides 4*a* and 4*b*. As an engagement method, for example, the engagement portions 51 may be formed in the form of protrusions to be fit into the holes 32 and 44, or alternatively, they may be engaged firmly with screws. Consequently, the guides 3*a* and 3*b* and the rear end guides 4*a* and 4*b* are supported at the top ends.

Piled sheets P are discharged toward the image forming apparatus 2 from the vicinity of the top end of the front wall plate 55. The front wall plate 55 is therefore slightly smaller than the side wall plates in height. Sheets P are transported from a portion defined by this difference. In short, the sheet discharge port 54 is defined by this difference.

The lifting plate 10 described above is provided inside the sheet accommodation portion 5. Of all the through-holes 15 and 16 made in the lifting plate 10, the through-holes 15 and 16 other than those being used are omitted in FIG. 3. The position of sheets P piled on the lifting plate 10 is restricted in a reliable manner by the guides 3*a* and 3*b*, the rear end guides 4*a* and 4*b*, and the front wall plate 55 of the sheet accommodation portion 5 by the configuration described above. To be more specific, the position of sheets P of each size is restricted in such a manner that sheets P come into contact with the pick-up portion 11 at the centers of an interval between the guides 3*a* and 3*b* and an interval between the guides 4*a* and 4*b*, that is, the center of sheets P in the width direction.

Figure 4:
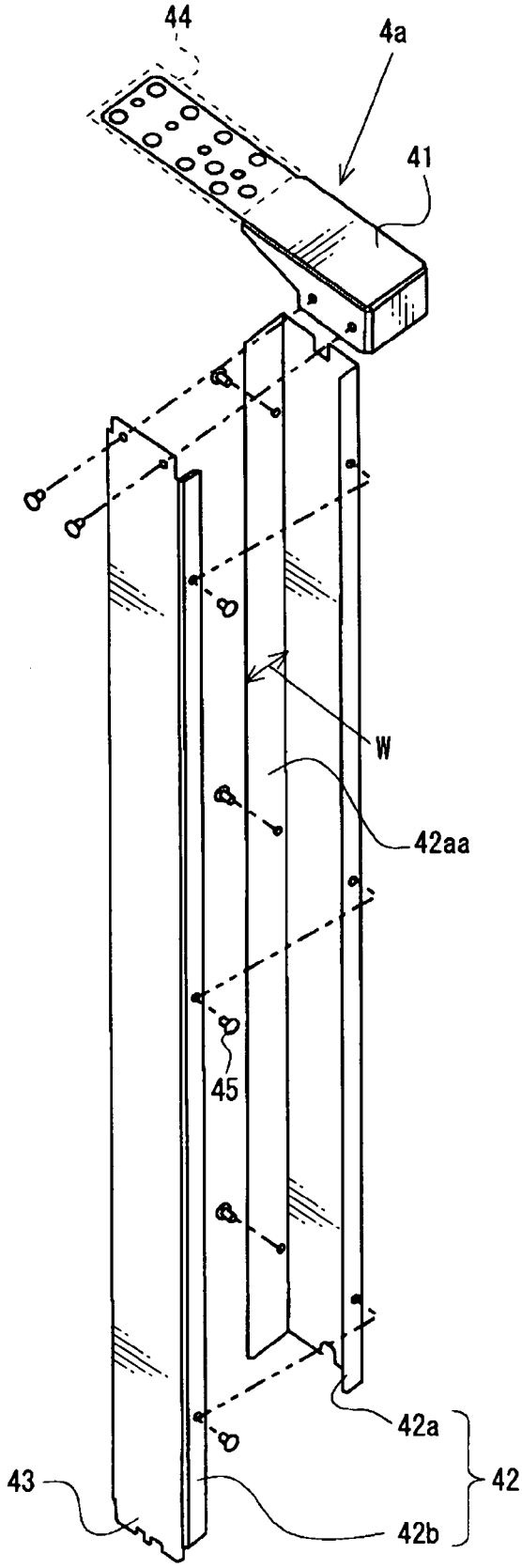
FIG. 4 is an exploded perspective view of a rear end guide according to one embodiment of the invention.

The configuration of the rear end guides 4*a* and 4*b* will now be described with reference to FIG. 4. FIG. 4 is an exploded perspective view of the rear end guide 4*a* according to one embodiment of the invention. The sheet feeding device 1 of this embodiment is provided with two rear end guides 4*a* and 4*b*. However, because a difference between these two is only a direction in which the fixing member 41 and the rear end guide member 42 are attached and these two are basically of the same configuration, descriptions of the rear end guide 4*b* are omitted herein.

The rear end guide 4*a* is roughly formed of two members: the fixing member 41 and the rear end guide member 42. The fixing member 41 is provided with plural holes 44 to be engaged with the engagement portions 51 provided on the top edge of the corresponding side plate 52 of the sheet accommodation portion 5. By changing the position of the holes 44 to be engaged with the engagement portions 51, it is possible to change the fixing position of the rear end guide 4*a* inside the sheet accommodation portion 5. The sheet feeding device 1 thus becomes adaptable to sheets P of various sizes using the single rear end guide 4*a* without having to prepare another rear end guide 4*a*.

The rear end guide member 42 is formed by combining two members. To be more concrete, two members each having a horizontal cross section in the shape of a capital U are combined. By combining two members, strength of the rear end guide 4*a* is ensured. Of the two U-shaped members, let the member on the right in FIG. 4 be a first rear end guide member 42*a* and the member on the left be a second rear end guide member 42*b*.

Widths of the side faces of the first rear end guide member 42*a* and the second rear end guide member 42*b* are equal except for one side face of the first rear end guide member 42*a*. In other words, a width W of a left side face 42*aa* of the first rear end guide member 42*a* in FIG. 4 is different from the others and is greater than the widths of the other side faces. This configuration is to restrict the position of sheets P at the rear ends in a reliable manner by allowing this portion to protrude for the side ends of piled sheets P to abut on this protruding portion.

The first rear end guide member 42*a*, the second rear end guide member 42*b*, and the fixing member 41 are joined together using rivets 45, vises, or screws, or by means of welding. FIG. 4 shows a case where all the members are joined together with plural rivets 45 by way of example.

An inserting portion 43 is provided at the bottom end of the second rear end guide member 42*b*. By inserting the inserting portion 43 into the slit 56*b* made in the bottom plate 53 of the sheet accommodation portion 5, the rear end guide 4*a* is supported at the bottom end.

Figure 5A:
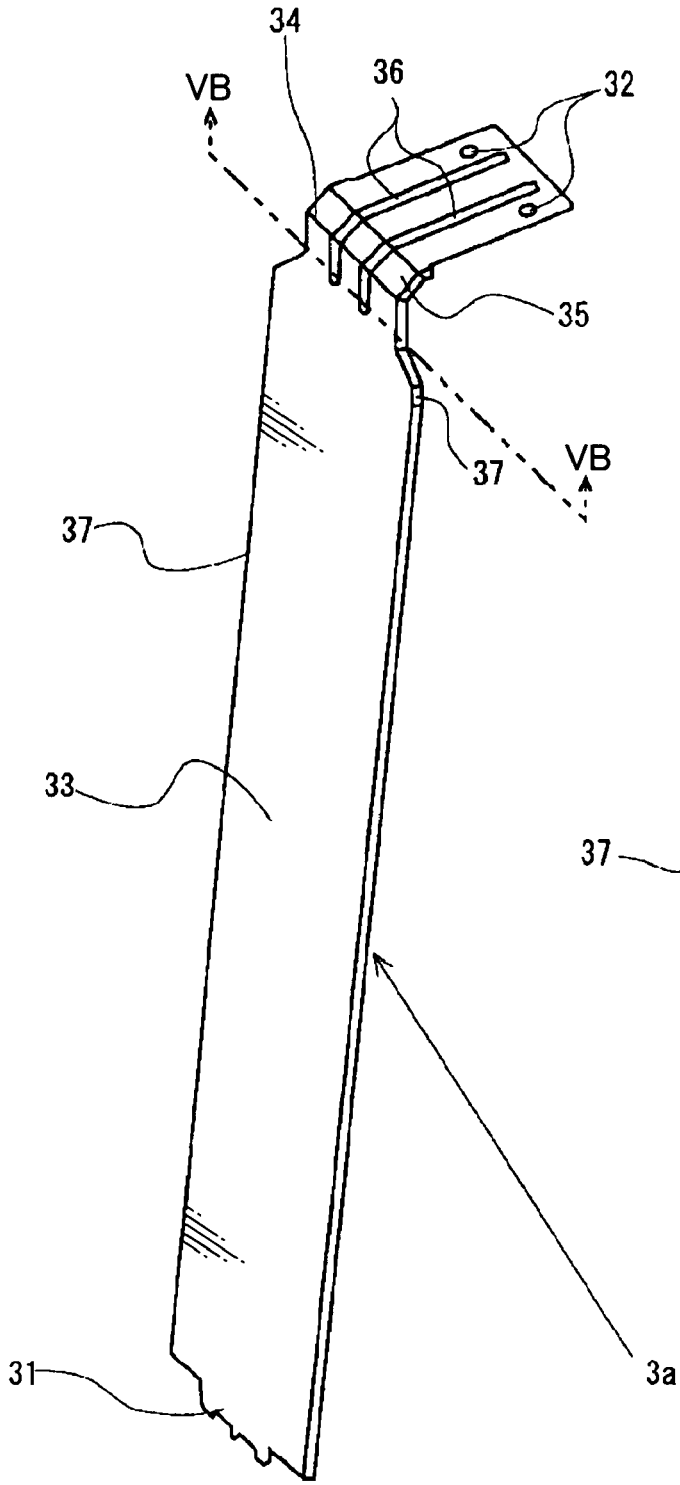
FIG. 5A is a perspective view of the guide according to one embodiment of the invention.
Figure 5B:
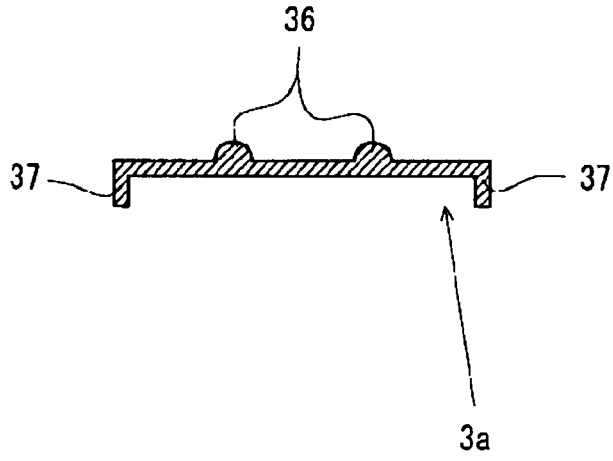
FIG. 5B is a cross section (taken on line VB-VB in FIG. 5A) of the guide.

The configuration of the guides 3*a* and 3*b* will now be described in detail with reference to FIG. 5A and FIG. 5B. FIG. 5A is a perspective view of the guide 3*a* according to one embodiment of the invention. FIG. 5B is a cross section (taken on line VB-VB in FIG. 5A) of the guide 3*a*. The sheet feeding device 1 of this embodiment is provided with two guides 3*a* and 3*b*. However, because a difference between these two is only a direction in which they are bent and these two are basically of the same configuration, descriptions of the guide 3*b* are omitted herein.

The guide 3*a* is to restrict sheets P piled in the sheet accommodation portion 5 to a position in a direction parallel to the sheet transportation direction. The guide 3*a* is formed by bending a plate-shaped member. Examples of the plate-shaped member include but not limited to a steel plate.

The guide 3*a* is formed to have a cross section in the vertical direction almost in the shape of a capital L, and as is shown in FIG. 5A, it is formed to have an inclined surface 35 in a top end portion 34 of an abutting surface 33 that abuts on sheets P. The angle of the inclined surface 35 is about 45° in FIG. 5A. It should be appreciated that the invention is not limited to this specific angle and the angle can be changed as needed.

In comparison with a case where the top end portion 34 of the abutting surface 33 is formed square as in the prior art, in a case where the inclined surface 35 is provided, the user is allowed to put his or her hand holding sheets P to be replenished on the inclined surface 35 during sheet replenishment, that is, it is possible to secure a space where the user rests his or her hand on during sheet replenishment. This facilitates a sheet replenishment work with the sheet feeding device 1. In addition, the user seldom hits his or her hand against the top end portion 34 of the abutting surface 33 during sheet replenishment. It is thus possible to provide the sheet feeding device 1 that enables the user to replenish sheets with ease and thereby offers an enhanced convenience to the user.

As is shown in FIG. 5A, the guide 3*a* is provided with two protruding strips 36 extending across the abutting surface 33 abutting on sheets P and the inclined surface 35 to the top end of the guide 3*a* along a direction in which sheets P are inserted. In the case of the guide 3*a* of this embodiment, in comparison with a case where a portion corresponding to the inclined surface 35, for example, the top end portion of the abutting surface 33, is made square, a friction between the guide 3*a* and sheets P may possibly be increased when sheets P to be replenished are placed on the inclined surface 35 during sheet replenishment. In some cases, sheets P may possibly get stuck on the inclined surface 35 of the guide 3*a*.

However, by providing one or more than one protruding strip 36, it is possible to lessen resistance caused by such a friction. It is thus possible to provide the sheet feeding device 1 that enables the user to replenish sheets P with ease and thereby offers an enhanced convenience to the user. It is preferable to make the cross section of the protruding strip 36 in a shape having no acute angle, such as a semi-circle, because a sense of contact the user might feel when his or her hand touches the guide 3*a* becomes gentler.

As is shown in FIG. 5B, side ends 37 of the guide 3*a* are bent in a direction so as not to abut on sheets P. As is shown in FIG. 5A, the side ends 37 of the guide 3*a* are bent from the vicinity of the inclined surface 35 toward the bottom end of the guide 3*a*. Because the side ends 37 of the guide 3*a* are bent in this manner, even when the user hits his or her hand against the side ends 37 of the guide 3*a*, the impact he or she might feel can be lessened in comparison with a case where the side ends 37 are not bent. In addition, in a case where the user holds the guide 3*a* when he or she changes the fixing position of the guide 3*a*, the guide 3*a* becomes easier to hold owing to the presence of the side ends 37. Further, because they are bent in a direction so as not to abut on sheets P, they do not interfere with the restriction of the position of sheets P.

Meanwhile, the holes 32 are made in the vicinity of the top end of the guide 3*a*. The holes 32 are to be engaged with the engagement portions 51 provided to the top ridge of the corresponding side plate 52 of the sheet accommodation portion 5. For example, they are fastened to each other with vises, screws, or the like to support the guide 3*a* at the top end. The inserting portion 31 is provided to the bottom end of the guide 3*a*. The inserting portion 31 is inserted into the appropriate slit 56*a* among the plural slits 56*a* made in the bottom plate 53 of the sheet accommodation portion 5. According to this configuration, the guide 3*a* is supported and positioned in a reliable manner. The position of the guide 3*a* can be readily changed by changing the engagement position with the engagement portions 51 and the slits 56*a* in which the inserting portion 31 is inserted in response to a sheet size. The sheet feeding device 1 thus becomes adaptable to sheets P of various sizes (see FIG. 3).

As has been described, the sheet feeding apparatus 1 of this embodiment is provided to the image forming apparatus 2 and includes the sheet accommodation portion 5 that accommodates piled sheets P for feeding sheets P to the image forming apparatus 2. The sheet feeding device 1 includes the guide 3*a* and 3*b* that are formed by bending a plate-shaped member and abutted on sheets P for restricting the position of sheets P loaded inside. In each of the guides 3*a* and 3*b*, the inclined surface 35 is formed on the top end portion 34 of the abutting surface 33 abutting on sheets P, so that the user can put his or her hands holding sheets P to be replenished on the inclined surfaces 35 during sheet replenishment.

It is thus possible to secure spaces where the user can rest his or her hands on during sheet replenishment, which facilitates the sheet replenishment work with the sheet feeding device 1 and thereby offers an enhanced convenience to the user. In addition, because the top end portions 34 of the guides 3*a* and 3*b* are the inclined surfaces 35 instead of being square, the top end portions 34 hardly interfere with the sheet replenishment work. As has been described, it is possible to provide the sheet feeding device 1 that enables the user to replenish sheets with ease and thereby offers an enhanced convenience to the user.

The guides 3*a* and 3*b* are provided with one or more than one protruding strip 36 along the insertion direction of sheets P. When configured in this manner, a friction between sheets P and the guides 3*a* and 3*b* can be lessened when sheets P are replenished in comparison with a case where no protruding strip 36 is provided. It is thus possible to provide the sheet feeding device 1 that enables the user to replenish sheets P without resistance such that sheets P get stuck on the inclined surfaces 35 of the guides 3*a* and 3*b* and thereby offers an enhanced convenience to the user.

In addition, the side ends 37 of the guides 3*a* and 3*b* are bent in a direction so as not to abut on sheets P. When configured in this manner, even when the user hits his or her hands against the side ends 37 of the guides 3*a* and 3*b*, the impact he or she might feel can be lessened in comparison with a case where the side ends 37 are not bent. In addition, the guide 3*a* and 3*b* becomes easier to hold when the user holds the guides 3*a* and 3*b* to change the fixing positions of the guides 3*a* and 3*b*. Further, because they are bent in a direction so as not to abut on sheets P, they do not interfere with the restriction of the position of sheets P.

Further, the sheet accommodation portion 5 is formed of the bottom plate 53 disposed in a horizontal posture and plural side plates 52 provided perpendicularly to the bottom plate 53, and opens at the top surface. The bottom plate 53 is provided with plural slits 56*a* and plural engagement portions 51 are provided to the top edge of each side plate 52. The inserting portions 31 to be inserted into the slits 56*a* are provided at the bottom ends of the guides 3*a* and 3*b*, and plural holes 32 to be engaged with the engagement portions 51 are provided to the top ends thereof. The guides 3*a* and 3*b* are positioned as the inserting portions 31 are inserted into the slits 56*a* and the holes 32 are engaged with the engagement portions 51. The fixing positions of the guides 3*a* and 3*b* can be therefore readily changed when a size of sheets P is changed.

While the invention has been described by way of the embodiment, it should be appreciated that the scope of the invention is not limited to the descriptions above and various modifications are possible without deviating from the scope of the invention.

For example, in the embodiment above, the guides 3*a* and 3*b* that restrict sheets P in a direction parallel to a sheet transportation direction are provided with the inclined surfaces 35 and the protruding strips 36. However, the rear end guides 4*a* and 4*b* that restrict the rear ends of sheets P may have the inclined surfaces 35 and the protruding strips 36 as well.

The embodiment above has described the sheet feeding device 1 having a large capacity and external to the image forming apparatus 2. The invention, however, is also applicable to a sheet feeding device having a relatively small capacity, such as a sheet feeding cassette provided inside the image forming apparatus 2. The invention is therefore applicable to any sheet feeding device 1 using the guides 3*a* and 3*b* without being limited by a capacity.

The specific embodiment described above chiefly includes inventions having the following configurations.

A sheet feeding device according to an aspect of the invention includes a sheet accommodation portion that accommodates piled sheets, and a guide formed by bending a plate-shaped member and having an abutting surface that abuts on the piled sheets so as to restrict a position of the piled sheets, wherein an inclined surface is formed in a top end portion of the abutting surface.

An image forming apparatus according to another aspect of the invention includes an apparatus main body that performs an image forming operation for sheets, and a sheet feeding device that feeds the sheets to the apparatus main body and has the configuration described above.

According to the sheet feeding device and the image forming apparatus described above, because the top end portion of the surface of the guide abutting on the sheets is formed to have the inclined surface, the user is able to put his or her hand holding sheets to be replenished on the inclined surface during sheet replenishment. It is thus possible to secure a space where the user rests his or her hand on during sheet replenishment, which facilitates a sheet replenishment work with the sheet feeding device. Further, because the top end portion of the guide is the inclined surface instead of being square, the top end portion seldom causes a nuisance during the sheet replenishment work. As has been described, it is possible to provide a sheet feeding device or an image forming apparatus that enables the user to replenish sheets with ease and thereby offers an enhanced convenience to the user.

In the configuration described above, it is preferable that one or more than one protruding strip is provided to the guide on a surface on a side where the abutting surface is formed along a direction in which the sheets are inserted into the sheet accommodation portion.

According to this configuration, because one or more than one protruding strip is provided to the guide along the sheet insertion direction, a friction between the sheets and the guide is lessened when the sheets are replenished in comparison with a case where no protruding strip is provided. It is thus possible to provide a sheet feeding device that enables the user to replenish sheets without resistance such that sheets get stuck on the inclined surface of the guide and thereby offers an enhanced convenience to the user.

In the configuration described above, it is preferable that the abutting surface extends in a vertical direction and the guide has a top end surface that extends in a direction almost orthogonal to the abutting surface, and that the inclined surface is positioned between the top end surface and the abutting surface. In this case, it is preferable that the inclined surface is provided with one or more than one protruding strip along a direction in which the sheets are inserted into the sheet accommodation portion. In particular, it is preferable that the protruding strip is provided across at least a part of the top end surface and the abutting surface.

According to the configuration described above, it is preferable that a side end of the guide is bent in a direction so as not to abut on the sheets. In this case, it is particularly preferable that side ends of the inclined surface and the abutting surface are bent in the direction so as not to abut on the sheets.

According to the configurations described above, because the side end of the guide is bent, even when the user hits his or her hand against the side end of the guide, the impact he or she might feel can be lessened in comparison with a case where the side end is not bent. In addition, the guide becomes easier to hold when the user holds the guide to change the fixing position of the guide. Further, because the side end is bent in a direction so as not to abut on the sheets, the side end does not interfere with the restriction of the position of the sheets.

In the configurations described above, it may be configured in such a manner that: the sheet accommodation portion includes a bottom plate disposed in a horizontal posture and plural side plates provided perpendicularly to the bottom plate, and opens at a top surface; the bottom plate is provided with a first engagement portion and each side plate is provided with a second engagement portion at a top edge thereof; and the abutting surface of the guide extends in a vertical direction, a third engagement portion that engages with the first engagement portion is provided to a bottom end of the guide, and a fourth engagement portion that engages with the second engagement portion is provided at a top end of the guide. When configured in this manner, the fixing position of the guide can be readily changed when a size of sheets is changed.

In this case, it is preferable that the first engagement portion and the second engagement portion are provided in a plural form at different positions. Also, it is one of preferred embodiments to configure in such a manner that the first engagement portion is a slit and the third engagement portion is an inserting portion inserted into the slit. Further, it is also one of preferred embodiments to configure in such a manner that the second engagement portion is an engagement protrusion and the fourth engagement portion is a hole into which the engagement protrusion is fit.

This application is based on patent application No. 2006-254582 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet feeding device, comprising:

a sheet accommodation portion that accommodates piled sheets; and a guide formed by bending a plate-shaped member and having an abutting surface that abuts on the piled sheets so as to restrict a position of the piled sheets, wherein an inclined surface is formed in a top end portion of the abutting surface.

2. The sheet feeding device according to claim 1, wherein:

one or more than one protruding strip is provided to the guide on a surface on a side where the abutting surface is formed along a direction in which the sheets are inserted into the sheet accommodation portion.

3. The sheet feeding device according to claim 1, wherein:

the abutting surface extends in a vertical direction and the guide has a top end surface that extends in a direction almost orthogonal to the abutting surface; and the inclined surface is positioned between the top end surface and the abutting surface.

4. The sheet feeding device according to claim 3, wherein:

the inclined surface is provided with one or more than one protruding strip along a direction in which the sheets are inserted into the sheet accommodation portion.

5. The sheet feeding device according to claim 4, wherein:

the protruding strip is provided across at least a part of the top end surface and the abutting surface.

6. The sheet feeding device according to claim 1, wherein:

a side end of the guide is bent in a direction so as not to abut on the sheets.

7. The sheet feeding device according to claim 6, wherein:

side ends of the inclined surface and the abutting surface are bent in the direction so as not to abut on the sheets.

8. The sheet feeding device according to claim 1, wherein:

the sheet accommodation portion includes a bottom plate disposed in a horizontal posture and plural side plates provided perpendicularly to the bottom plate, and opens at a top surface;

the bottom plate is provided with a first engagement portion and each side plate is provided with a second engagement portion at a top edge thereof; and the abutting surface of the guide extends in a vertical direction, a third engagement portion that engages with the first engagement portion is provided to a bottom end of the guide, and a fourth engagement portion that engages with the second engagement portion is provided at a top end of the guide.

9. The sheet feeding device according to claim 8, wherein:

the first engagement portion and the second engagement portion are provided in a plural form at different positions.

10. The sheet feeding device according to claim 8, wherein:

the first engagement portion is a slit and the third engagement portion is an inserting portion inserted into the slit.

11. The sheet feeding device according to claim 8, wherein:

the second engagement portion is an engagement protrusion and the fourth engagement portion is a hole into which the engagement protrusion is fit.

12. An image forming apparatus, comprising:

an apparatus main body that performs an image forming operation for sheets; and a sheet feeding device that feeds the sheets to the apparatus main body, wherein the sheet feeding device includes:

a sheet accommodation portion that accommodates piled sheets; and a guide formed by bending a plate-shaped member and having an abutting surface that abuts on the piled sheets so as to restrict a position of the piled sheets, and wherein an inclined surface is formed in a top end portion of the abutting surface.

13. The image forming apparatus according to claim 12, wherein:

one or more than one protruding strip is provided to the guide on a surface on a side where the abutting surface is formed along a direction in which the sheets are inserted into the sheet accommodation portion.

14. The image forming apparatus according to claim 12, wherein:

a side end of the guide is bent in a direction so as not to abut on the sheets.

15. The image forming apparatus according to claim 12, wherein:

the sheet accommodation portion includes a bottom plate disposed in a horizontal posture and plural side plates provided perpendicularly to the bottom plate, and opens at a top surface;

the bottom plate is provided with a first engagement portion and each side plate is provided with a second engagement portion at a top edge thereof; and the abutting surface of the guide extends in a vertical direction, a third engagement portion that engages with the first engagement portion is provided to a bottom end of the guide, and a fourth engagement portion that engages with the second engagement portion is provided at a top end of the guide.

* * * * *